US007417207B2

(12) United States Patent
Wittenhagen et al.

(10) Patent No.: US 7,417,207 B2
(45) Date of Patent: Aug. 26, 2008

(54) HEATING DEVICE WITH TEMPERATURE SENSOR AND HOB WITH HEATING DEVICES

(75) Inventors: Wolfgang Wittenhagen, Bretten (DE); Wolfgang Thimm, Karlsruhe (DE); Eugen Wilde, Knittlingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 11/831,141

(22) Filed: Jul. 31, 2007

(65) Prior Publication Data

US 2008/0000893 A1 Jan. 3, 2008

Related U.S. Application Data

(63) Continuation of application No. PCT/EP2006/000699, filed on Jan. 27, 2006.

(30) Foreign Application Priority Data

Feb. 1, 2005 (DE) ..... 10 2005 005 520

(51) Int. Cl.
*H05B 3/68* (2006.01)

(52) U.S. Cl. ..... 219/446.1; 219/465; 219/1

(58) Field of Classification Search .... 219/443.1–468.2
See application file for complete search history.

(56) References Cited

U.S. PATENT DOCUMENTS

| | | | | |
|---|---|---|---|---|
| 3,267,733 A | | 8/1966 | Chambers | |
| 3,710,076 A | * | 1/1973 | Frazier | 219/448.17 |
| 4,243,874 A | * | 1/1981 | Fischer | 219/448.11 |
| 4,414,465 A | | 11/1983 | Newton et al. | |
| 4,447,711 A | | 5/1984 | Fischer | |
| 5,220,155 A | | 6/1993 | Cunningham | |
| 5,694,107 A | * | 12/1997 | Moriwake et al. | 338/22 R |
| 5,877,475 A | | 3/1999 | Hecht et al. | |
| 6,272,735 B1 | | 8/2001 | Moriwake et al. | |
| 6,483,084 B2 | * | 11/2002 | Petri et al. | 219/460.1 |
| 6,538,238 B1 | | 3/2003 | Berkcan et al. | |
| 6,995,344 B2 | | 2/2006 | McWilliams | |

FOREIGN PATENT DOCUMENTS

| | | |
|---|---|---|
| DE | 27 29 930 | 1/1979 |
| DE | 31 16 771 A1 | 11/1982 |
| DE | 35 45 445 A1 | 6/1987 |

(Continued)

OTHER PUBLICATIONS

International Search Report from PCT/EP2006/000699, dated Apr. 12, 2006.

(Continued)

*Primary Examiner*—S. Paik
(74) *Attorney, Agent, or Firm*—Alston & Bird LLP

(57) ABSTRACT

A hob comprising a plurality of radiant heating devices, each of which is further comprised of a support and a heat conductor mounted thereon. An elongate and tubular temperature sensor having a temperature sensitive element in a glass envelope extends along the support and is embedded therein to such a degree so as to project only slightly upwards. Ends of the temperature sensor with connections extend to the edge of the support or even project beyond.

26 Claims, 2 Drawing Sheets

FOREIGN PATENT DOCUMENTS

| | | | |
|---|---|---|---|
| DE | 195 27 825 | A1 | 1/1997 |
| DE | 19537431 | A1 | 4/1997 |
| DE | 19925367 | A1 | 1/2000 |
| DE | 10 2004 004 022 | A1 | 8/2005 |
| EP | 0116861 | | 8/1984 |
| EP | 0 138 314 | A1 | 4/1985 |
| FR | 2 261 695 | | 9/1975 |
| FR | 2521293 | | 8/1983 |
| GB | 1257 148 | | 12/1971 |
| GB | 1 562 251 | | 3/1980 |
| GB | 2 072 334 | A | 9/1981 |

OTHER PUBLICATIONS

German Search Report for German Application No. 102005005520.6.

* cited by examiner

HEATING DEVICE WITH TEMPERATURE SENSOR AND HOB WITH HEATING DEVICES

CROSS REFERENCE TO RELATED APPLICATIONS

This application is a continuation of PCT/EP2006/000699, filed Jan. 27, 2006, which is based on German Application No. 10 2005 005 520.6, filed Feb. 1, 2005, of which the contents of both are hereby incorporated by reference.

FIELD OF APPLICATION AND PRIOR ART

The invention generally relates to a heating device, such as is advantageously used for hobs having a glass or glass ceramic cover, as well as a hob with several heating devices.

BACKGROUND

It is for example known from DE 199 42 967 to place an excess temperature protection device in the form of a rod controller with an elongated, rod-like expansion element on a heating device in the form of radiant heaters. This excess temperature protection device more particularly serves to ensure that a maximum permitted temperature on a glass ceramic plate of a hob running over the heating device is not exceeded. The casing thereof outside the radiant heater is fixed to a receiving dish or tray. The rod-like expansion element projects into the interior of the radiant heater and can be fixed, for example by clips or upright, hook-like holders. However, the fixing of the casing to the outside of the receiving tray incurs costs, particularly assembly costs.

The problem addressed by one embodiment of the invention is to provide an aforementioned heating device and a hob making it possible to avoid the disadvantages of the prior art and where in particular the arrangement of a temperature sensor on a heating device can be simplified.

BRIEF DESCRIPTION OF THE DRAWINGS

Embodiments of the invention are diagrammatically shown in the drawings and are explained in greater detail hereinafter.

DETAILED DESCRIPTION OF EMBODIMENTS

Figure 1:
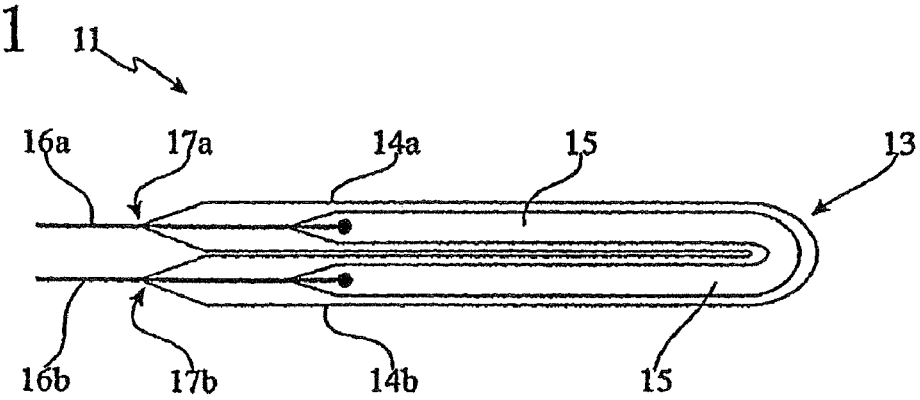
FIG. 1 illustrates a larger scale view of an embodiment of a U-shaped temperature sensor with glass tube.

This problem is solved in one embodiment by a heating device having the features of claim 1 and a hob having the features of claim 27. Advantageous and preferred developments of the invention are given in the further claims and are explained in greater detail hereinafter. By express reference the wording of the claims is made into part of the content of the description.

The heating device has both a temperature sensor and a support structure (or simply "support"), an elongated heating conductor being located on, or over, the top of the support. The heating conductor is more particularly constructed and positioned so that it covers a significant part of the support surface, for example in a spiral, meandering or mixed form. The temperature sensor is inventively preponderantly or even exclusively fixed or secured to the support and is arranged on the support so as to be in contact therewith. This means that it is advantageously placed or engages with a significant part of its length or extension on the support. Thus, particularly compared with the aforementioned prior art, this obviates the need for fixing to a receiving tray of the support. Moreover, the support and temperature sensor can be preassembled to form a module, independently of the nature of the receiving tray used. This permits constructions without a receiving tray.

The temperature sensor is advantageously elongated. In particular, it is in the form of a single or double, curved tube, in which can be placed a temperature sensitive element.

The temperature sensor is advantageously constructed for temperature determination via electrical evaluation, i.e., not via the mechanical expansion behaviour as a result of a temperature change or the like. This makes it possible to construct it smaller and without moving parts, because no expansion forces or the like act thereon or have to be detected.

In another embodiment of the invention, the temperature sensor can at least partly be embedded in the support material, or run in a channel in said support. Advantageously, it is in substantially complete contact with the support material and can engage on the support over a significant part of its length. This leads to a substantially complete supporting or bearing on the support material in order to bring about a very good retention. An embedding of the temperature sensor in the support also permits fixing the sensor against lateral movements. A retention of the temperature sensor on the support can be implemented in one embodiment in the lateral direction and in another embodiment in the vertical direction, in each case independently of one another, or also in combination with one another in advantageous manner. A channel or recess in which the temperature sensor runs can be separately provided for this purpose. It is also possible for the support to have a recess or channel for housing or guiding electrical leads for the heating conductor on the support. Simultaneously, the temperature sensor can be fitted here or the recess can have a double function. It is also possible to produce the recess for the temperature sensor through a sandwich structure with corresponding preshaped support parts. One of the latter parts can then have the recess and parts above the same can at least partly cover the recess again and upwardly directed windows can also be provided.

The support can have a substantially planar or uniform surface, at least in some or significant areas. In one embodiment, the temperature sensor can project somewhat above the same, i.e. is not completely embedded in the support. The projection can either represent only a small part, for example, more particularly to allow temperature determination to take place in this area.

Alternatively, it is also possible for the support having a substantially planar surface or flat shape to be provided with an elevation or protuberance in which the temperature sensor runs. An embedding of the temperature sensor in such an elevation can be advantageously constructed in such a way that a significant part, and in particular most of the temperature sensor, is embedded in the support or is covered by the support material of the elevation. Continuing this idea, it is also possible to provide on a substantially flat support an aforementioned elevation in which the temperature sensor is largely embedded or which retains the latter. However, significant length regions of the sensor can be laterally free from the elevation and although resting on the support, are largely free so as to be able to implement temperature determination undisturbed by effects of the support. In this case such an elevation mechanically retains the temperature sensor. An elevation can also run in spaced manner and be constructed as a lateral protection.

It is also possible to place the temperature sensor substantially below the plane or top surface of the flat support, i.e., so-to-speak below the heating conductors. The temperature sensor can either be upwardly exposed or largely covered with the support material. In connection with the evaluation of such a temperature sensor, embedding the sensor in the support material does not make it possible to directly determine the temperature on the heating conductors or in an area above said heating conductors. In such case, it is either possible to use correction factors or with such an arrangement the support temperature can be very readily determined, if this is desired.

In a fundamentally different construction, the temperature sensor can be placed on the support, being substantially exposed or unembedded in the support. The functionality significant parts are not embedded, nor are parts embedded that would have an affect on the temperature determination. In this way, for example, a temperature sensitive element of the temperature sensor would be shielded from the support material. Fixing can take place by retaining means, which may comprise use of engaging clips, projecting fastening members, etc.

In a further embodiment of the invention, the temperature sensor may be shielded against direct irradiation by the heating conductors positioned laterally alongside the same. This can advantageously take place by using shielding in the form of a support material layer. However, it is not necessary to embed the temperature sensor particularly deeply in the support. Instead, relatively narrow walls or webs can be provided. In particular, the temperature sensor should slope upwards to the side and the directly upwards portion should be exposed for a particularly good determination of the temperature, for example, on a glass ceramic hob plate running over the same.

As mentioned hereinbefore, the temperature sensor advantageously has a temperature sensitive measuring element, which is advantageously metallic or a metal piece or metal wire. A temperature sensitive element is advantageously elongated, in particular, able to determine a temperature over a larger area. The temperature sensitive element should be placed in an envelope, which is preferably made from temperature and/or radiation-transmitting material. Particular preference use is made of glass, for example in the form of a glass tube. The transmission properties of the glass can be modified or optimized for example by colouring, doping, etc. Metal envelopes are also possible.

The temperature sensitive element can advantageously be outwardly electrically contacted by means of temperature sensor connecting wires. If it is located in a glass envelope, the connecting wires must be introduced here and are generally sealed in. Advantageously said seals are located outside the heating device or outside the support and in particular beyond the direct heating action of the heating device in order to avoid excessive thermal stresses or destruction. Advantageously, the temperature sensor projects with one end, particularly an envelope end with electrical connections, laterally over the heating device. This permits good contacting, for example, by welding or soldering or with a releasable connection.

In a further embodiment of the temperature sensor, a temperature sensitive element in elongated form can run parallel to an aforementioned connecting wire and is advantageously inside the envelope and can be connected, advantageously welded thereto.

In another embodiment of the invention, it is possible for the envelope to be constructed as a capillary tube in which runs the temperature sensitive element. It can at least partly contact one wall of the capillary tube. Further, in larger areas, or on a longer section, it can engage and in particular be supported thereon.

The temperature sensor can advantageously be placed on the support in such a way that in the support plane heating conductors are only located laterally alongside the temperature sensor. However, there are no heating conductors which are higher or lower. In particular, all the heating conductors of the heating device are roughly located in a plane or define such a plane.

In a further embodiment, the temperature sensor can also be inclined to the plane of the otherwise substantially flat support or its top surface. Advantageously, it is covered in one longitudinal area by a support material layer, whereas in another longitudinal area it is free, for example at the end, where it can particularly satisfactorily determine the temperature.

The temperature sensitive element can in particular be a combination of metal and ceramic. The ceramic can have PTC (positive temperature coefficient) properties and can contain at least one high temperature conductor. The temperature sensitive element advantageously has a low thermal capacity, so that a rapid response of the temperature sensor is made possible. It can have a temperature coefficient of the specific electrical resistance which is higher than that of platinum, for example, such as silver or tungsten. It can also be so designed that the temperature dependence of its electrical resistance compensates or reduces the variation between the temperature of a glass ceramic plate running over the heating device and that which is determined by the temperature sensitive element within specific temperature ranges.

Another possibility for a temperature sensitive element is an optical temperature sensor.

It is also possible to place such a temperature sensitive element on its own sensor support, such as that made of ceramic material. It can be enveloped to the outside with a ceramic envelope, comprising several parts. The support can also constitute the sensor element.

Such a temperature sensitive element can advantageously be produced using a conventional thick film or thin film process. In particular, it can in this way be applied to a sensor support.

Due to the fact that the temperature sensor is placed on the support or even is embedded by a small portion therein, it is possible to bring the heating device or heating conductor closer to the underside of a hob plate running over the same. This makes it possible to reduce the size and increase the transmission of heating power via radiation through a reduced distance. In particular, the heating wire can freely irradiate and be exposed, or open to the top, which leads to an optimum heating action.

An inventive hob can have one or more heating devices and they are advantageously constructed as described hereinbefore. It also has a hob plate below which are located the one or more heating devices. Compared with known hobs, the distance between the underside of the hob plate and the heating devices is reduced and can be very small. It is advantageously less than 2 cm, and possible only 1 cm or even less. This permits the aforementioned reduction of the overall height. In addition, there can be a higher power introduction of the heating device through the hob plate into a cooking vessel standing thereon. Preferably all the heating devices are constructed according to the same principle or have embedded or lowered temperature sensors.

It is also possible to economize a separate connection member.

Whilst retaining the complete overall height or using part of the gained overall height, the thermal insulation can be increased or made more cost effective. The thermal insulation can be partly or completely replaced by a foamed glass or sandwich-like structures. This makes it possible to reduce the heating of the cooking appliance containing the heater. Such a heating device can for example be manufactured using the following steps:

a) placing a simple filling material, such as powdered glass or foamed glass, in a receiving tray such as a sheet metal tray or dish,
b) introduce the temperature sensor, and
c) place an insulating layer with fumed silica over the same.

A heating conductor can then be fixed over the insulating layer.

These and further features can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

One embodiment is shown in FIG. 1 that shows a temperature sensor 11, which is elongated and has a U-shaped glass tube 13 as an envelope. The upper part 14*a* and lower part 14*b* of glass tube 13 are very close to one another. Alternatively, the two parts can have a greater spacing. It is also possible to construct the temperature sensor with a single, substantially straight or elongated tube, preferably of quartz glass.

The glass tube 13 contains a diagrammatically represented elongated, temperature sensitive element 15. The latter can be constructed in numerous different ways and can be both a metal wire made from a corresponding metal and a temperature sensitive layer applied to a support. Electrical contacting on the temperature sensitive element 15 takes place by means of connecting wires 16*a*, 16*b*, which are firmly welded thereto. At the point at which the connecting wires 16 pass out of the glass tube 13 are provided seals 17*a*, 17*b*. Thus, it is possible to provide a protective gas atmosphere or a vacuum in the interior of the glass tube.

Figure 2:
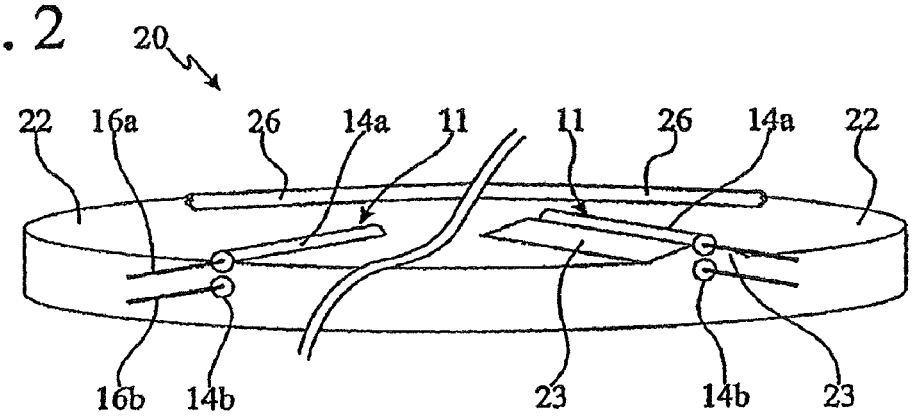
FIG. 2 illustrates a view of two embodiments of how a temperature sensor according to FIG. 1 is partly embedded in an inventive heating device.

FIG. 2 shows a first embodiment of the invention. A heating device 20 has a disk-like or plate-like support 22 made from a thermally insulating material, such as is for example described in DE 2551137 A or EP 750 444 A. A heating conductor 26, in the embodiment shown an upright heating conductor strip, runs thereon. It can be partly embedded in support 22 or have retaining members extending into the same. The top of support 22 is substantially planar and all the heating conductors 26 also run in one plane.

The difference in FIG. 2 between the left and right-hand examples relates to the elongated elevation 23 of the right-hand example. In both cases the temperature sensor 11 is admittedly entirely embedded with lower part 14*b* in support 22. The upper part 14*a* projects roughly by half from the same or projects over the thermal insulating material of support 22. In the right-hand example it can be seen that without elevation 23 upper part 14*a* would project or be positioned over support 22. Thus, here elevation 23 in addition to a mechanically stabilizing action can bring about a certain shielding effect to the side. This is particularly advantageous if it is not possible to embed the temperature sensor 11 more deeply in support 22.

It can also be seen in FIG. 2 that the ends of glass tube 13 or upper part 14*a* and lower part 14*b* project laterally at least by a small amount or can be freely accessible from support 22. This more particularly applies to seals 17*a*, 17*b*, so that also the connecting wires 16*a*, 16*b* are completely exposed or not covered by the material of support 22.

The shape or form of elevation 23 can vary. Besides a represented, relatively gentle rise, a steeper rise is possible. The elevation 23 can also be wider or longer than shown. However, advantageously, it only runs in the immediate vicinity around temperature sensor 11, because it would otherwise have a negative effect on the fastening of heating conductors 26 and as a result manufacturing costs are also low.

FIG. 2 illustrates the basic principle that in this embodiment although temperature sensor 11 is embedded in support 22 or its material, only a portion projects over the same. In particular, it is not covered at the top, so that it can detect thermal radiation from a hob plate located above the same.

In split form FIG. 3 once again shows an inventive heating device 120 in a second embodiment. Support 122 has elongated, roughly U-shaped channels 124. Whereas in the representation according to FIG. 2 the temperature sensor can already be sealed with looser thermal insulating material in the initial state together with the support 22. Here, the channel 124 is already present prior to the introduction of temperature sensor 111. The fastening of temperature sensor 111 in channel 124 can result from accurate fitting construction accompanied by pressing in. It is also possible to stick fast or use retaining clips. Here again the ends of upper part 114*a* and lower part 114*b* or connecting wires 116 should be readily accessible or a portion thereof should project over the lateral, circumferential edge of support 122.

It can also be seen how a lead 127 to heating conductor 126 runs and is guided to the outside at least partly in channel 124. To make it easier to reach heating conductor 126, channel 124 or part thereof can also be led up to heating conductor 126. In this case temperature sensor 111 only takes up part of the total length of channel 124.

Figure 3:
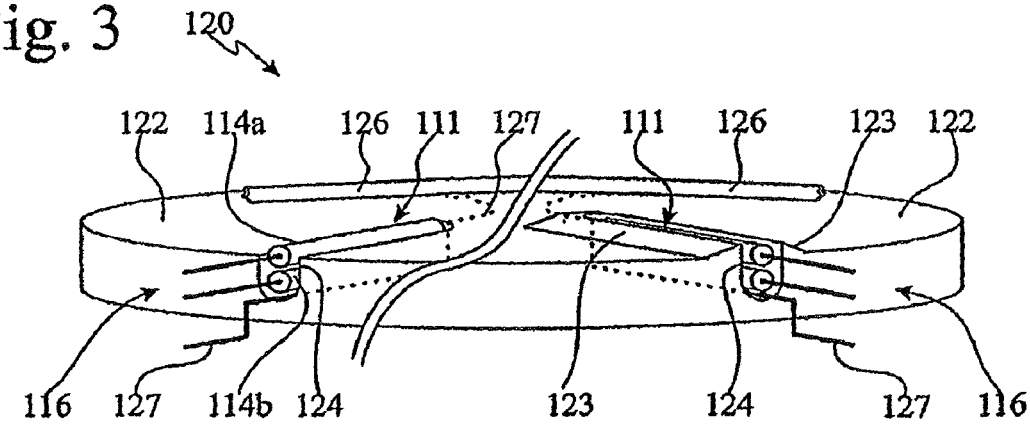
FIG. 3 illustrates an embodiment of the heating device of FIG. 2, in which the temperature sensor is placed in a prefabricated channel.

In the left-hand half of FIG. 3, upper part 114*a* of temperature sensor 111 projects somewhat over the top of the otherwise flat support 122. However, in the right-hand half, an elevation 123 is provided on either side of channel 124. As a result for the same embedding depth of the temperature sensor in the support the latter is also completely shielded to the side by the thermal insulating material. Thus, at no point does the temperature sensor 111 project over support 122 or its material. As is readily apparent, it is completely open or can readily determine thermal radiation in the upwards direction, i.e., in the direction in which it is intended to measure a temperature.

Figure 4:
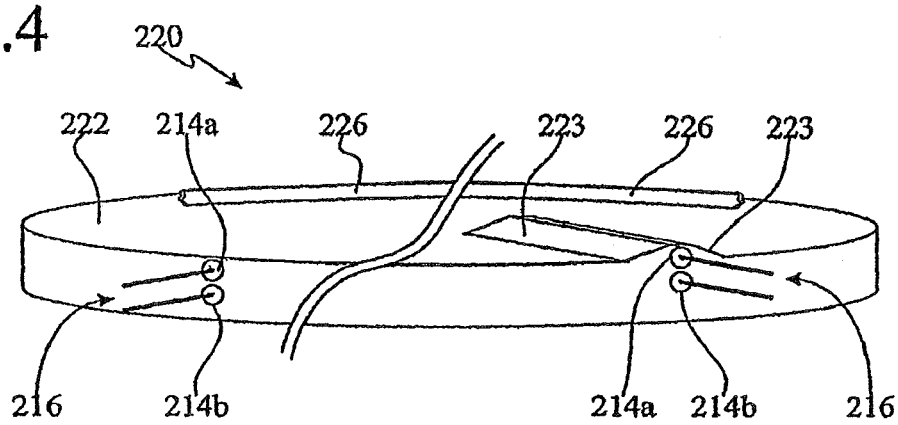
FIG. 4 illustrates a further embodiment of the heating device of FIG. 2, in which the temperature sensor is completely embedded in a heating device support.

FIG. 4 shows a third embodiment once again in a split representation, showing how the temperature sensor 211 is completely embedded in support 222 or its material. In both cases it does not project over and at no point is it exposed. Only the ends project somewhat to the side.

It must be borne in mind that, much as in FIG. 3, in the left-hand half temperature sensor 211 is located substantially below heating conductor 226. Thus, it could also run through below the same. However, in the right-hand half the upper part 214*a* of temperature sensor 211 would not be embedded or exposed without the elevation 223 and project over the material of support 222. Without the elevations 123 in FIG. 3, the upper part 114*a* would be exposed to the side and thermal radiation from heating conductors 126 could act thereon.

Much as stated in connection with FIG. 2, the embodiment according to FIG. 4 illustrates the temperature sensor 211 can either be moulded with the thermal insulating material to the finished support, or not shown recesses can be provided, much like the channels in FIG. 3 and into which is inserted the temperature sensor. However, they are then not open to the top.

Figure 5:
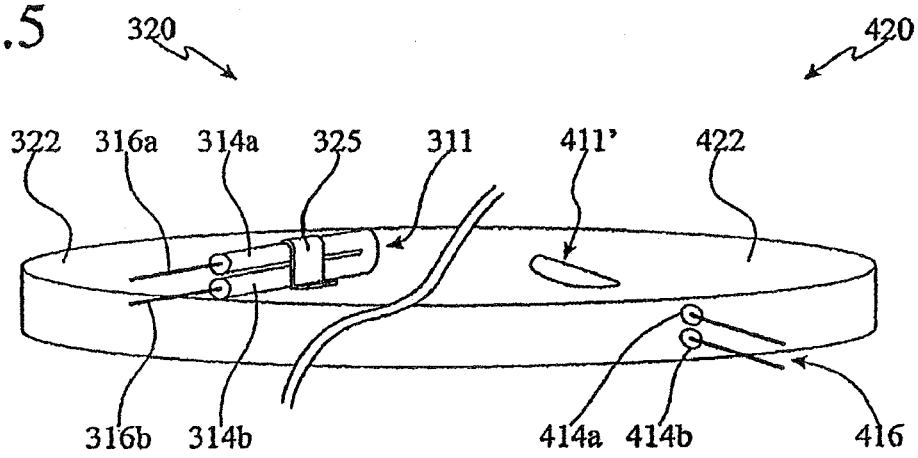
FIG. 5 illustrates two further embodiments of the heating device of FIG. 2, in which the temperature sensor in one embodiment is placed completely on the heating device support and in another embodiment projects in part therefrom.

To the left in FIG. 5 is shown a fourth embodiment. Here the temperature 311 is placed on the top of support 322 and rests completely thereon or over the same. Fastening takes place by means of retaining clips 325 embracing the same in U-shaped manner and anchored in not shown manner to support 322. For this purpose it is either possible to use bonding or can be inserted or introduced therein with projecting portions. Heating conductors are not shown here.

Once again it is possible to provide on one or both sides of temperature sensor 311 elevations similar to those of FIGS. 2 to 4, which project upwards from the support and which either laterally fix or at least partly laterally cover temperature sensor 311. The retaining clips 325 can then either extend into the elevation or project laterally thereover.

To the right in FIG. 5 is shown a fifth embodiment, in which the temperature sensor 411 is inclined to the surface of support 422. With one end 411' it projects out of the support and can for example in this area carry out the temperature measurement. The ends of tubes 414 with connections 416 once again project laterally and are accessible for contacting purposes.

Figure 6:
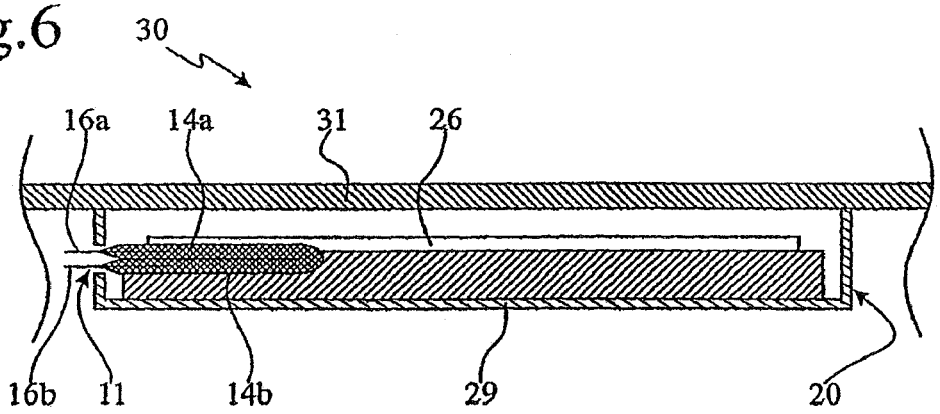
FIG. 6 illustrates a side view of the hob according to one embodiment of the invention.

FIG. 6 shows an inventive hob 30 with an advantageously glass ceramic hob plate 31. Below the latter is provided a heating device 20 similar to that in the left-hand half of FIG. 2. There is also a receiving tray 29 in which is located heating device 20. The receiving tray 29 is pressed onto the underside of hob plate 31.

It can be seen that heating conductors 26 project over the temperature sensor upper part 14*a*. They have a certain spacing from the underside of hob plate 31 and this is determined by the lateral edge of the receiving tray. However, this spacing is a few millimetres or approximately one centimetre and is consequently much smaller than in the prior art radiant heaters. In the latter in part the temperature must run between the heating conductors and hob plate and maintain a certain minimum spacing.

The connecting wires 16*a*, 16*b* of temperature sensor 11 lead to an evaluation or control means (not shown), which evaluate the detected temperature together with the temperature sensor 11 or temperature sensitive element 15.

The invention claim is:

1. A heating device for use in a cooking appliance having a glass or glass ceramic cover, said heating device comprising:

a temperature sensor located underneath said glass or glass ceramic cover; and a support having a recess in which are located said temperature sensor and an electrical lead for a heating conductor, wherein on a top surface of said support is a substantially planar surface except for a first and second area adjacent to each side of said recess, wherein a majority portion of said temperature sensor is substantially located within said recess of said support and a remaining portion of said temperature sensor projects over said top surface of said support, said projection occurring toward a side where said heating conductor is located, wherein said support is inclined at said first and second area adjacent on each side of said recess against said remaining portion of said temperature sensor without being higher or lower than said remaining portion of said temperature sensor, wherein further on said top surface is located said heating conductor and wherein said temperature sensor is fixed to said support.

2. The heating device according to claim 1, wherein said temperature sensor has an elongated shape.

3. The heating device according to claim 1, wherein said temperature sensor comprises a tube comprising a quartz based glass material.

4. The heating device according to claim 1, wherein said temperature sensor is constructed for temperature determination via electrical evaluation.

5. The heating device according to claim 1, wherein said support comprises a channel forming said recess and said temperature sensor is at least partly located within said channel.

6. The heating device according to claim 5, wherein said temperature sensor is inclined to a plane relative to said top surface on which said heating conductor is located.

7. The heating device according to claim 6, wherein said support further comprises a support material and wherein said temperature sensor is covered by a layer of said support material over one longitudinal area and is exposed over another longitudinal area.

8. The heating device according to one claim 1, wherein said temperature sensor is in contact with said support and is directly embedded therein.

9. The eating device according to claim 1, wherein said remaining portion of said temperature sensor projects by a maximum of one third of the temperature sensor over said substantially planar surface.

10. The heating device according to claim 1, wherein said temperature sensor is located below said heating conductor.

11. The heating device according to claim 10, wherein said support further comprises a support material and said heating conductor is covered by a layer of said support material.

12. The heating device according to claim 1, wherein said temperature sensor is placed in said recess of said support without embedding said temperature sensor in said support.

13. The heating device according to claim 12, wherein said temperature sensor is fastened to said support by retaining means.

14. The heating device according to claim 1, wherein said support further comprises a support material and wherein said temperature sensor is shielded against direct lateral irradiation by said heating conductor by said first and second area adjacent on each side of said recess of said support material.

15. The heating device according to claim 14, wherein said temperature sensor is shielded against said direct irradiation by said heating conductor by being partially embedded in said support.

16. The heating device according to claim 14, wherein said temperature sensor is shielded against said direct irradiation by said heating conductor by lateral elevations of said support at said first and second area adjacent on each side of said recess.

17. The heating device according to claim 1, wherein said temperature sensitive element, is elongated in shape.

18. The heating device according to claim 17, wherein said envelope comprises an electrically insulating material, wherein each seal around a respective connecting wire lead is located outside said heating device or outside said support.

19. The heating device according to claim 17, wherein said temperature sensitive element has a connection between a metal material and a ceramic material, said metal material or said ceramic material having positive temperature coefficient properties with at least one high temperature conductor.

20. The heating device according to claim 17, wherein said temperature sensitive element is made by a thick film production process.

21. The heating device according to claim 17, wherein said temperature sensitive element is made by a thin film production process.

22. The heating device according to claim 1, wherein said temperature sensor has one end with an electrical connection, wherein further said temperature sensor projects over said lateral edge of said support.

23. A cooking appliance comprising a glass-based cover and a plurality of heating devices, wherein each heating device is located under a respective hob plate, said each heating device comprises:

a temperature sensor located underneath said glass-based cover; and a support, having a recess in which are located said temperature sensor and an electrical lead for a heating conductor, wherein on a top surface of said support is a substantially planar surface except for a first and second area adjacent to each side of said recess, wherein a majority portion of said temperature sensor is substantially located within said recess of said support and a remaining portion of said temperature sensor projects over said top surface of said support, said projection occurring toward a side where said heating conductor is located, wherein said support is inclined at said first and second area adjacent on each side of said recess against said remaining portion of said temperature sensor without being higher or lower than said remaining portion of said temperature sensor, wherein further on said top surface is located said heating conductor and wherein said temperature sensor is fixed to said support.

24. The cooking appliance according to claim 23, wherein a spacing between said underside of said respective hob plate and said heating conductor is less than 2 cm.

25. The hob according to claim 24, wherein said heating conductor is a freely irradiating and at least partially exposed heating wire.

26. A cooking appliance comprising:

a glass based cover having a top side and a bottom side, said top side comprising a plurality of hob plates; and a plurality of heating devices, each heating device located under a respective hob plate and comprising:

a heating element, said heating element being circular and planar in shape, said heating element positioned underneath said glass-based cover;

a temperature sensor comprising a tubular quartz based glass enclosure, further comprising a temperature sensitive element enclosed therein, said temperature sensor comprising two electrical leads connected to said temperature sensitive element at one end; and a support structure supporting said heating element, said support structure having a circular shape with a circumferential edge; said support having a recess in which are located said temperature sensor and an electrical lead for a heating conductor, wherein on a top surface of said support is a substantially planar surface except for a first and second area adjacent to each side of said recess, wherein a majority portion of said temperature sensor is substantially located within said recess of said support and a remaining portion of said temperature sensor projects over said top surface of said support, said projection occurring toward a side where said heating conductor is located, wherein said support is inclined at said first and second area adjacent on each side of said recess against said remaining portion of said temperature sensor without being higher or lower than said remaining portion of said temperature sensor, wherein further on said top surface is located said heating conductor and wherein said temperature sensor is fixed to said support.

* * * * *